US009158274B2

(12) United States Patent
Sato

(10) Patent No.: US 9,158,274 B2
(45) Date of Patent: Oct. 13, 2015

(54) IMAGE FORMING APPARATUS

(75) Inventor: Yuki Sato, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 167 days.

(21) Appl. No.: 13/599,247

(22) Filed: Aug. 30, 2012

(65) Prior Publication Data

US 2013/0058676 A1 Mar. 7, 2013

(30) Foreign Application Priority Data

Sep. 5, 2011 (JP) ..... 2011-192693
May 28, 2012 (JP) ..... 2012-120630

(51) Int. Cl.
*G03G 21/20* (2006.01)
*G03G 21/18* (2006.01)

(52) U.S. Cl.
CPC ..... *G03G 21/206* (2013.01); *G03G 21/1803* (2013.01); *G03G 2215/0872* (2013.01)

(58) Field of Classification Search
CPC ..... G03G 21/206; G03G 2215/0872; G03G 2221/1645; G03G 21/1803
USPC ..... 399/92, 111
See application file for complete search history.

(56) References Cited

U.S. PATENT DOCUMENTS 7,403,741 B2 * 7/2008 Yoshihara et al. ..... 399/411
7,433,624 B2 * 10/2008 Ohkura ..... 399/92
7,599,641 B2 * 10/2009 Yoshihara et al. ..... 399/94
7,647,000 B2 * 1/2010 Ohkura ..... 399/92
7,840,156 B2 * 11/2010 Inaba ..... 399/92
7,937,015 B2 * 5/2011 Furuichi et al. ..... 399/94
7,941,069 B2 * 5/2011 Idehara et al. ..... 399/92
8,113,079 B2 * 2/2012 Suzuki et al. ..... 74/434
8,150,292 B2 * 4/2012 Ohashi ..... 399/92
8,417,142 B2 * 4/2013 Furuichi et al. ..... 399/94
8,577,246 B2 * 11/2013 Sakurai et al. ..... 399/92
8,676,081 B2 * 3/2014 Yamashita et al. ..... 399/92
8,693,915 B2 * 4/2014 Nozaki et al. ..... 399/92
2007/0071484 A1 * 3/2007 Igarashi ..... 399/92
2008/0063425 A1 * 3/2008 Idehara et al. ..... 399/93
2008/0282839 A1 * 11/2008 Suzuki et al. ..... 74/640
2010/0080606 A1 4/2010 Ohashi
2010/0098452 A1 * 4/2010 Inaba ..... 399/92
2011/0280609 A1 * 11/2011 Nakazawa et al. ..... 399/92
2011/0305477 A1 * 12/2011 Sakurai et al. ..... 399/92
2012/0107009 A1 * 5/2012 Yano ..... 399/92
2012/0219314 A1 * 8/2012 Nozaki et al. ..... 399/92
2013/0142538 A1 * 6/2013 Miwa et al. ..... 399/92

FOREIGN PATENT DOCUMENTS

CN 101145024 A 3/2008
JP 2003-057927 A 2/2003

(Continued)

*Primary Examiner* — David Gray
*Assistant Examiner* — Carla Therrien
(74) *Attorney, Agent, or Firm* — Harness, Dickey & Pierce, P.L.C.

(57) ABSTRACT

An image forming apparatus comprising: a built-in rotary driving member; a developing device detachably attachable to the body of the image forming apparatus; a developer driving part disposed at one end in a shaft direction of the developing roller and the agitation screw; a driving part duct enveloping the developer driving part of the developing device; a developer case surface duct formed along a surface parallel to the shaft direction of the developing roller and the agitation screw; and a blast fan or a exhaust fan to blow air from either the driving part duct or the developer case surface duct to each other.

8 Claims, 13 Drawing Sheets

(56) References Cited

FOREIGN PATENT DOCUMENTS

| | | |
|---|---|---|
| JP | 2005-140968 A | 6/2005 |
| JP | 2006-145727 | 6/2006 |
| JP | 2008-250284 | 10/2008 |
| JP | 2009-009074 | 1/2009 |
| JP | 2009-288583 | 12/2009 |

* cited by examiner

IMAGE FORMING APPARATUS

CROSS-REFERENCE TO RELATED APPLICATIONS

The present application claims priority from Japanese patent application numbers 2011-192693 and 2012-120630, filed on Sep. 5, 2011 and May 28, 2012, respectively, the entire contents of which are incorporated by reference herein.

BACKGROUND OF THE INVENTION

1. Field of the Invention

The present invention relates to an image forming apparatus such as a copier, a printer, a facsimile machine, or a multi-function apparatus having one or more capabilities of the above devices.

2. Description of the Related Art

In an image forming apparatus employing electrophotography, friction between a developer control member and a developer, friction between a developer carrier surface and the developer, and friction between developer particles cause heat to be generated and the heat generated increases a temperature of the developer. In addition, heat around the driving units such as gears, shafts, and bearings of a developing roller and a developer agitating screw is transmitted, via a screw shaft or a case that supports the shaft and the bearing, to increase the temperature of the developer. The increase in the temperature of the developer causes such problems as agglomeration and degradation of the developer.

To solve the above-described problem, it is possible to cool the developer. For example, JP-2009-009074-A discloses a method to cool the developer by blowing air onto the developer from the side of the developer unit.

Similarly, JP-2008-250284-A provides a duct in the image forming unit to block heat from a fixing unit and cool the image forming unit.

Further, JP-2009-288583-A discloses another approach, in which a duct is defined by a guide rail used for attaching a developer unit to a developer case, through which air is blown, thereby cooling the developer.

The above approaches are used to cool the developer via the developer case. By contrast, JP-2006-145727-A discloses a method of blowing air onto front and rear shaft bearings of the developing roller to counter the temperature rise of the developer due to the heat generated at a driving part.

However, none of the above cooling means and methods cools both the developer case and the driving part. If used in combination the cooling units would need to be provided at two locations in the front and the back sides of the developing device, which inevitably increases the size of the apparatus and its cost.

Further, it is known that energy lost as heat from the motor itself as the power source and the heat transmitted via the gears is propagated via the apparatus main frame and the internal air to the developer.

BRIEF SUMMARY OF THE INVENTION

Accordingly, in order to cool the developer efficiently, the present invention also cools the driving units such as gears, shafts, and bearings of the developing roller and the developer agitating screw and shield the developing unit from heat generated from the main frame side in the course of generating power to be transmitted to the developing unit.

More specifically, the present invention provides an improved image forming apparatus capable of effectively suppressing a temperature rise of the image forming unit and the optimal image forming unit includes built-in rotary drive members; a developing device detachably attachable to a body of the image forming apparatus; a developer driving part disposed at one end in a shaft direction of the developing roller and the agitation screw; a driving part duct enveloping the developer driving part of the developing device; a developer case surface duct formed along a surface parallel to the shaft direction of the developing roller and the agitation screw; and a blast fan or a exhaust fan to blow air from either the driving part duct or the developer case surface duct to each other.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Hereinafter, preferred embodiments of the present invention will now be described with reference to accompanying drawings.

Figure 1:
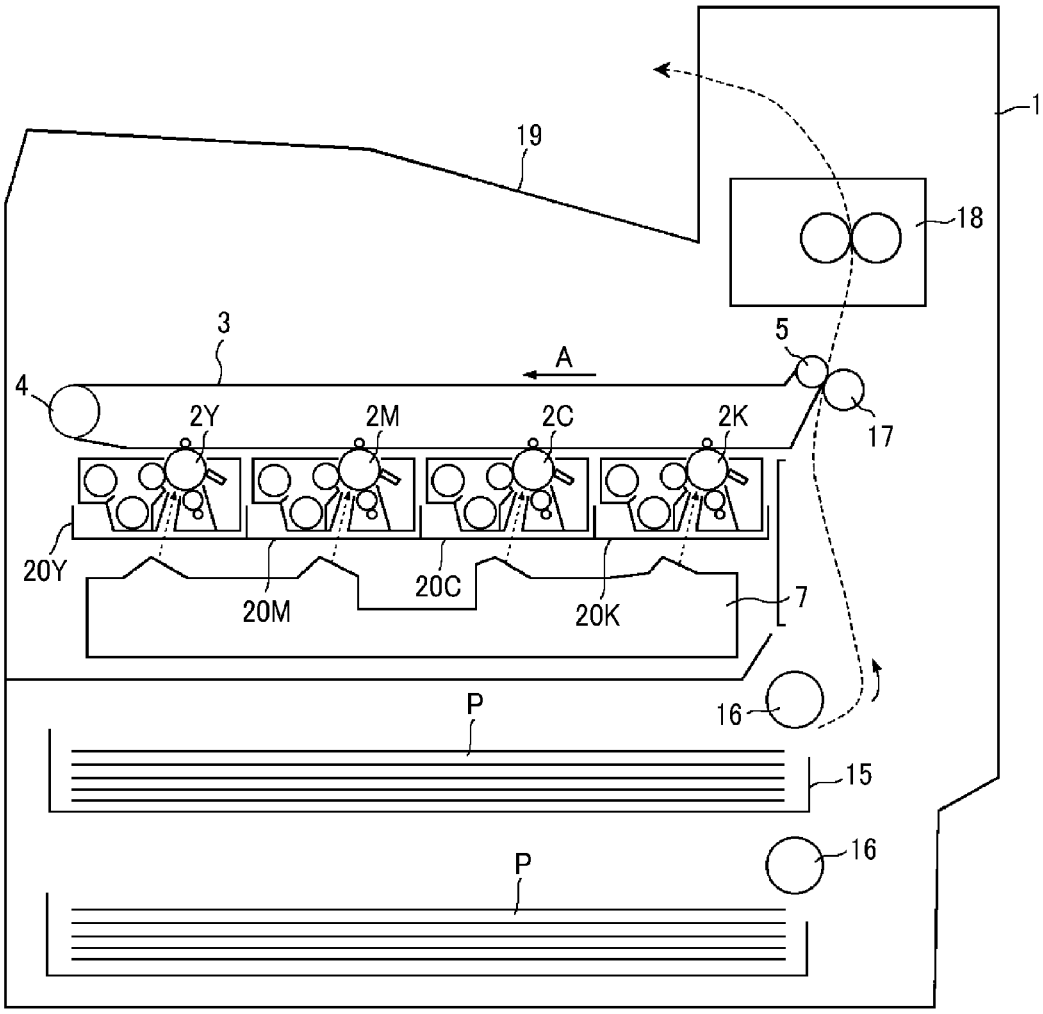
FIG. 1 shows a schematic view of an image forming apparatus related to an embodiment of the present invention.

FIG. 1 is a vertical cross-sectional view of an exemplary image forming apparatus to form a full-color image. As illustrated in FIG. 1, the image forming apparatus includes a main frame 1; first to fourth image carriers 2Y, 2M, 2C, and 2K each formed of a drum-shaped photoreceptor included in the main frame 1; and an endless intermediate transfer belt 3 disposed inside the main frame 1 of the image forming apparatus. The intermediate transfer belt 3 is wound around at least two support rollers 4 and 5 and is driven to rotate in a direction indicated by an arrow A in FIG. 1.

The intermediate transfer belt 3 is positioned above image carriers 2Y, 2M, 2C, and 2K and a lower-side running surface of the intermediate transfer belt 3 contacts each peripheral surface of the image carriers 2Y, 2M, 2C, and 2K. The intermediate transfer belt 3 serves as a transfer member on which each toner image of different color formed on each image carrier surface is transferred in a superposed manner.

A structure in which a toner image is formed on each of the first to fourth image carriers 2Y, 2M, 2C, and 2K and the toner image is transferred to the intermediate transfer belt 3 is substantially the same except that the color of the toner image is different from each other. Therefore, only a structure for forming a toner image on the first image carrier 2Y and transfer the toner image to the intermediate transfer belt 3 will be described as an example.

Figure 2:
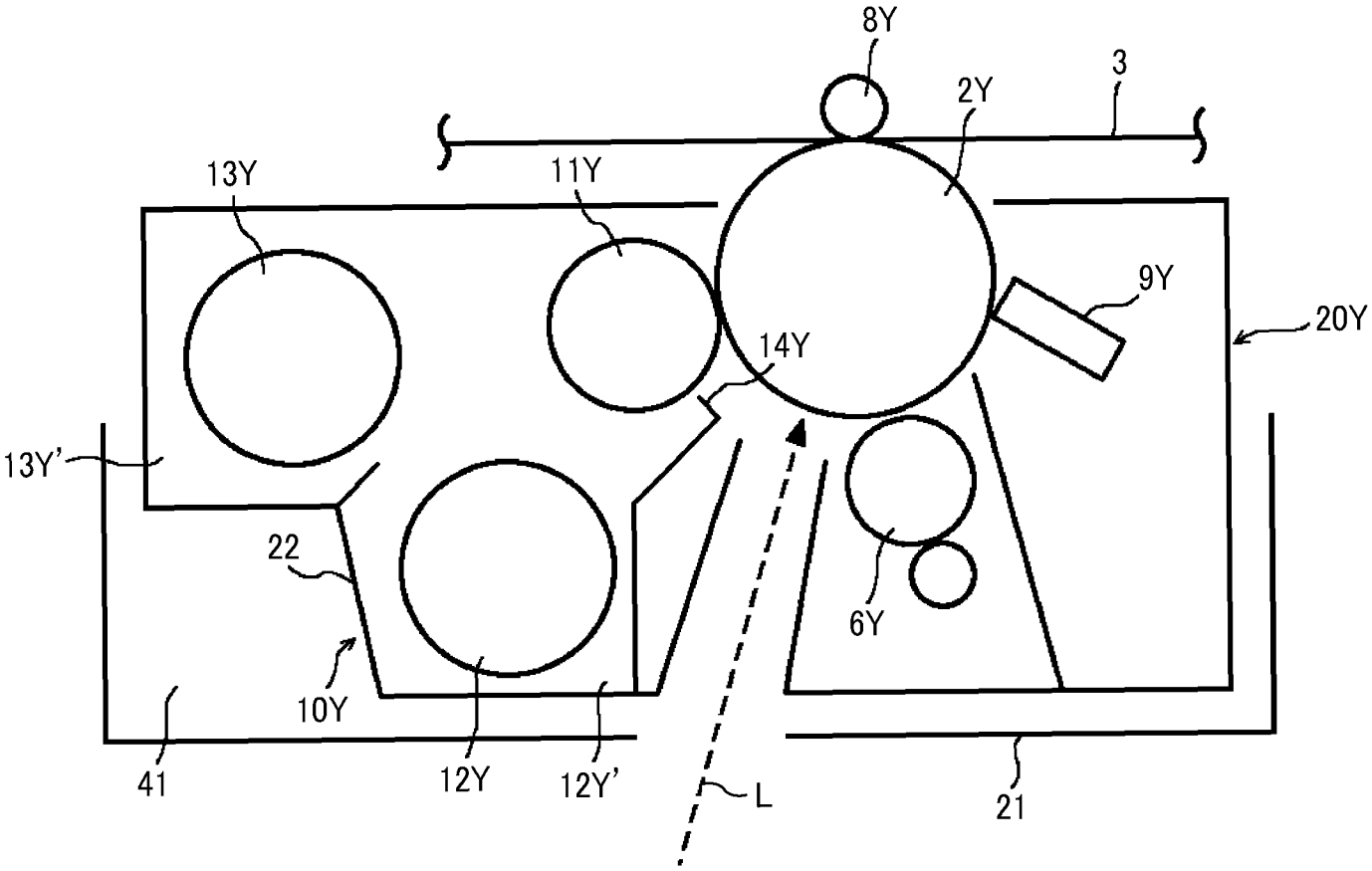
FIG. 2 is a schematic view illustrating a structure of an image forming unit included in the image forming apparatus of FIG. 1.

FIG. 2 is an explanatory view illustrating a structure of an image forming unit 20 including an image carrier 2 as illustrated in FIG. 1. Because four image forming units 20Y, 20M, 20C, and 20K are substantially the same except for the color of toner to be processed, the image forming unit 20Y including the first image carrier 2Y will be described as a representative.

As illustrated in FIG. 2, a charging roller 6Y is a charging device applied with charged voltage. While the image carrier 2Y is being driven to rotate in the clockwise direction, the image carrier 2Y is charged at a predetermined polarity by the charging roller 6Y. A modulated laser beam L is emitted from an optical writing unit 7 as illustrated in FIG. 1 to the image carrier 2, which has been charged. With this operation, an electrostatic latent image is formed on the image carrier 2Y. The electrostatic latent image is rendered visible as a yellow toner image by a developing device 10Y. The developing device 10Y includes a developing roller 11Y disposed opposite the image carrier 2Y, an agitation screw 12Y disposed in a supply conveyance path 12Y' to supply developer to the developing roller 11Y, an agitation screw 13Y disposed to a collection conveyance path 13Y' to collect the developer that has passed through a developing area, and a doctor blade 14Y to regulate a layer thickness of the developer carried on the developing roller 11Y. The agitation screws 12Y and 13Y each agitate the developer and conveys the developer in inverse directions to each other.

A primary transfer roller 8Y is disposed at an opposite side with respect to the image carrier 2Y with the intermediate transfer belt 3 sandwiched between. A transfer voltage is applied to the primary transfer roller 8Y so that the toner image carried on the image carrier 2Y is primarily transferred onto the intermediate transfer belt 3. The toner remaining on the image carrier 2Y after the primary transfer of the toner image is removed by a cleaning unit 9Y. When a surface of the image carrier 2Y after having passed the cleaning unit 9Y arrives at a charging roller 6Y, the surface of the image carrier 2Y is electrically discharged and charged simultaneously and is prepared for a next image formation.

Similar to the operation as described above, a cyan toner image, a magenta toner image, and a black toner image are respectively formed on the second to fourth image carriers 2M, 2C, and 2K as illustrated in FIG. 1, and these toner images are primarily and in a superposed manner transferred on the intermediate transfer belt 3 on which a yellow toner image has already been transferred, thereby forming a full-color toner image. As the toner remaining on the first image carrier 2Y after the primary transfer of the toner image is removed by the cleaning unit 9Y, the remaining toner after the primary transfer on each of the image carriers 2M, 2C, and 2K is also removed by each of the cleaning units 9M, 9C, and 9K.

As illustrated in FIG. 1, at a bottom in the image forming apparatus, a sheet feed cassette 15 containing recording media P or a transfer sheet and a sheet feed unit 14 containing a sheet feed roller 16 are disposed. An uppermost sheet of the recording media P is conveyed in an arrow direction in the figure. The sheet P fed from the sheet feed cassette 15 is conveyed via a positional adjustment roller pair (not shown) at a predetermined timing to a part between the intermediate transfer belt 3 wound around a support roller 5 and a secondary transfer roller 17 disposed opposite the intermediate transfer belt 3. At this time, a predetermined transfer voltage is applied to the secondary transfer roller 17, whereby the full-color toner image on the intermediate transfer belt 3 is secondarily transferred to the recording medium P.

The recording medium P on which the full-color toner image has been secondarily transferred is further conveyed upward to the fixing device 18, at which the toner image is fixed onto the recording medium P with heat and pressure. The recording medium P that has passed through the fixing device 18 is ejected to a sheet ejection unit 19 atop the body of the image forming apparatus 1. The toner remaining on the intermediate transfer belt 3 after the toner image transfer is cleaned by a belt cleaning unit, not shown. Each of the image forming units 20Y, 20M, 20C, and 20K are slidably mounted on a guide rail 21. Accordingly, each image forming unit 20Y, 20M, 20C, and 20K is slidable in a substantially perpendicular direction to the sheet surface and is detachably attachable to the body of the image forming apparatus 1.

Figure 3:
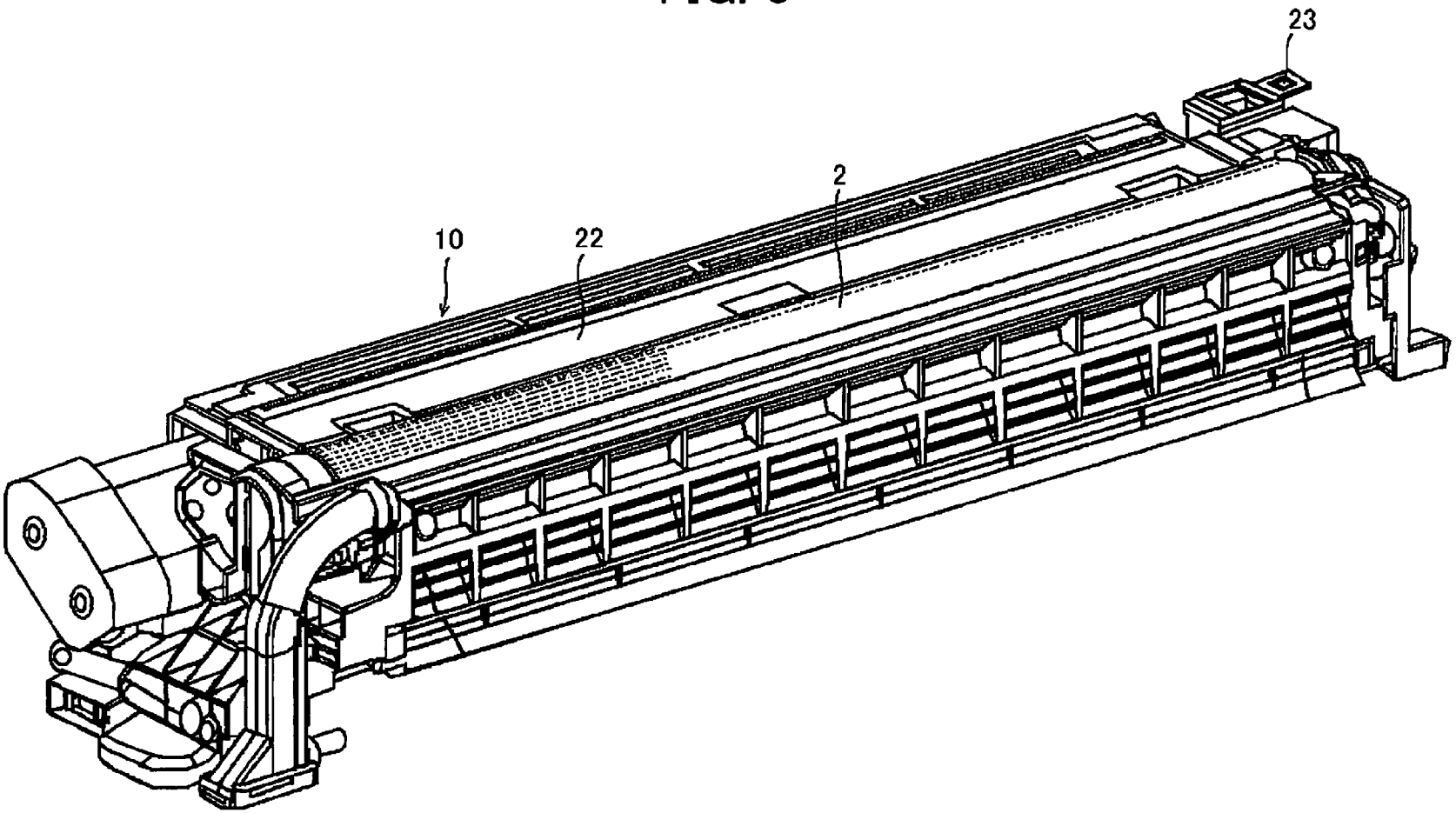
FIG. 3 is an oblique view illustrating a structure of an image forming unit included in the image forming apparatus of FIG. 1.
Figure 4:
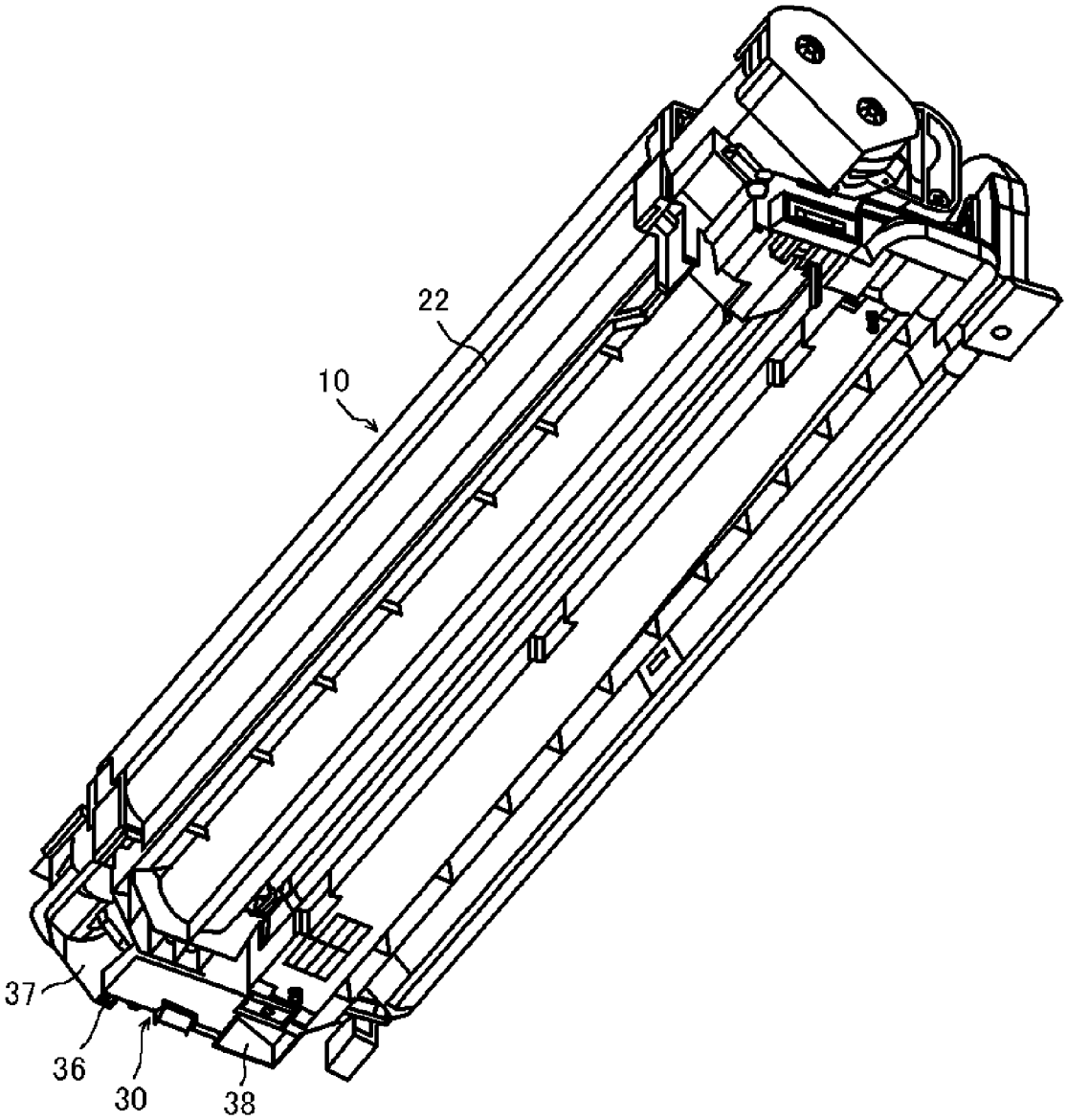
FIG. 4 is an oblique bottom view illustrating a structure of the image forming unit of FIG. 2.

FIG. 3 is an oblique view illustrating a structure of an image forming unit 20 and FIG. 4 is an oblique bottom view illustrating the image forming unit 20.

Figure 5:
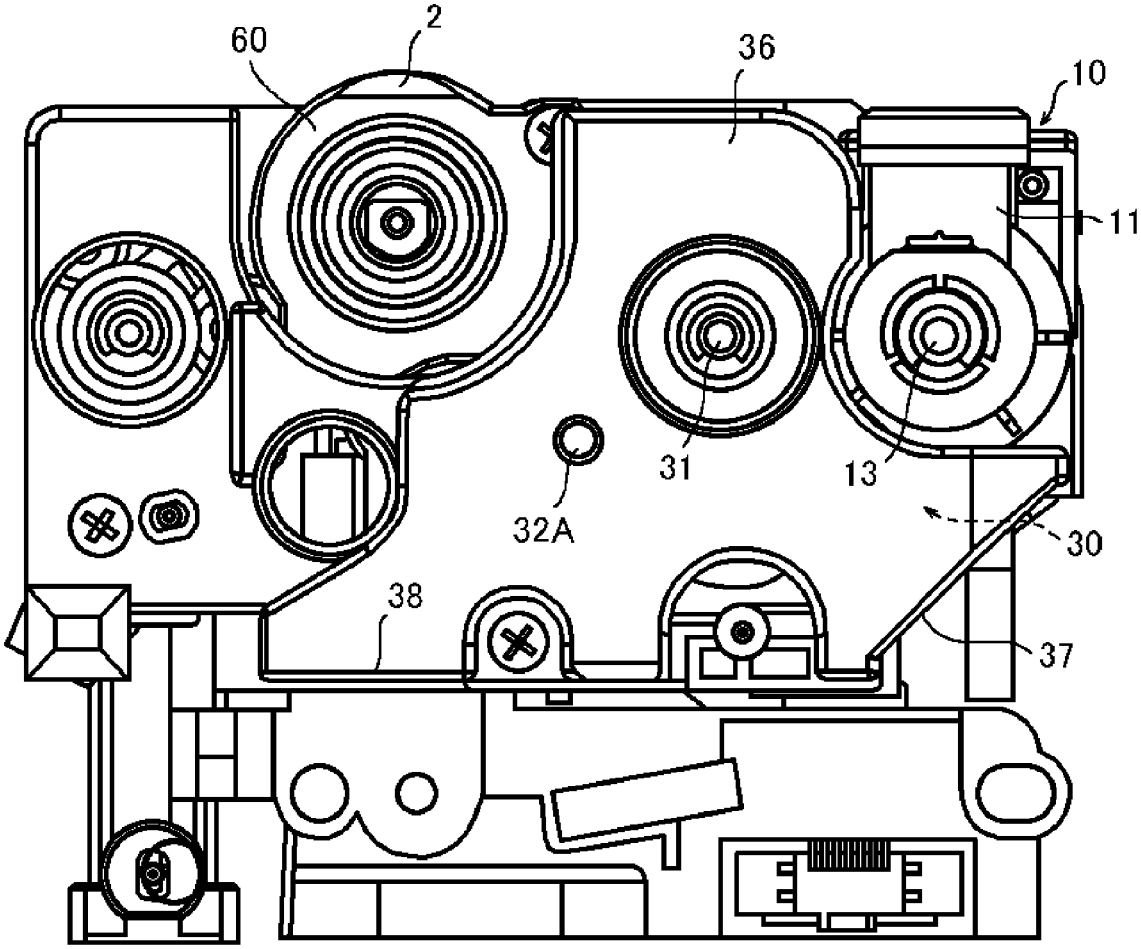
FIG. 5 is an explanatory view of a developer driving side.

In FIGS. 3 and 4, reference numeral 22 denotes a developer case of the developing device 10, with a supply port 23 disposed at a right edge of the developer case 22. Through the supply port 23, the developer formed of toner or toner and carrier is replenished to the developing device 10. As illustrated in FIG. 5, the developing device 10 of the image forming unit 20 includes a developer driving part 30 disposed at a rear end of the body of the image forming apparatus 1 and configured to transmit driving force to drive the developing roller 11 and the agitation screw 12 of the developing device 10. The developer driving part 30 is driven by a drive unit 50 (see FIG. 8) disposed at the body of the image forming apparatus 1. Reference numeral 60 shows a driving part of the image carrier 2. The driving part 60 is completely separated from the developer driving part 30. A detailed description of the driving part 60 will be omitted.

Figure 6:
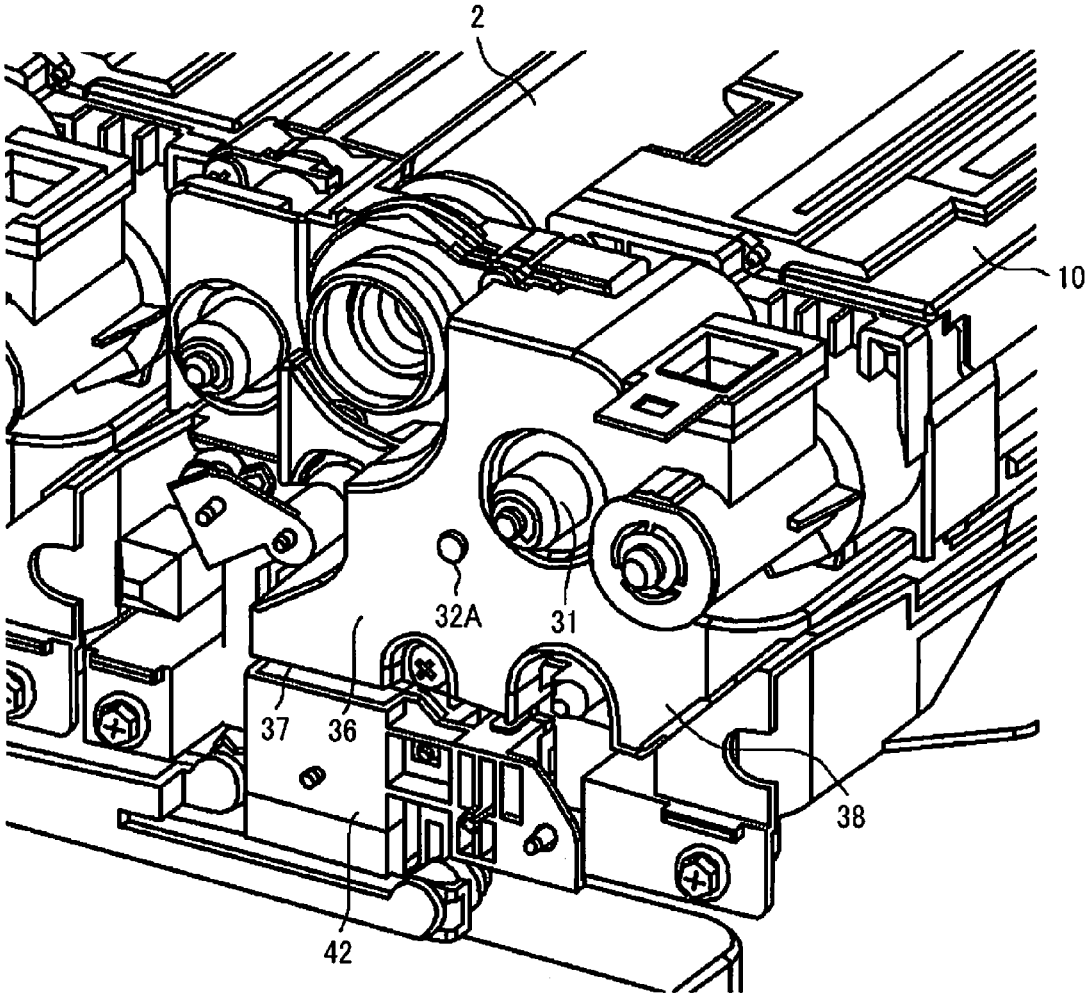
FIG. 6 is an oblique view illustrating a developer driving part to which a developing part duct is disposed.
Figure 7:
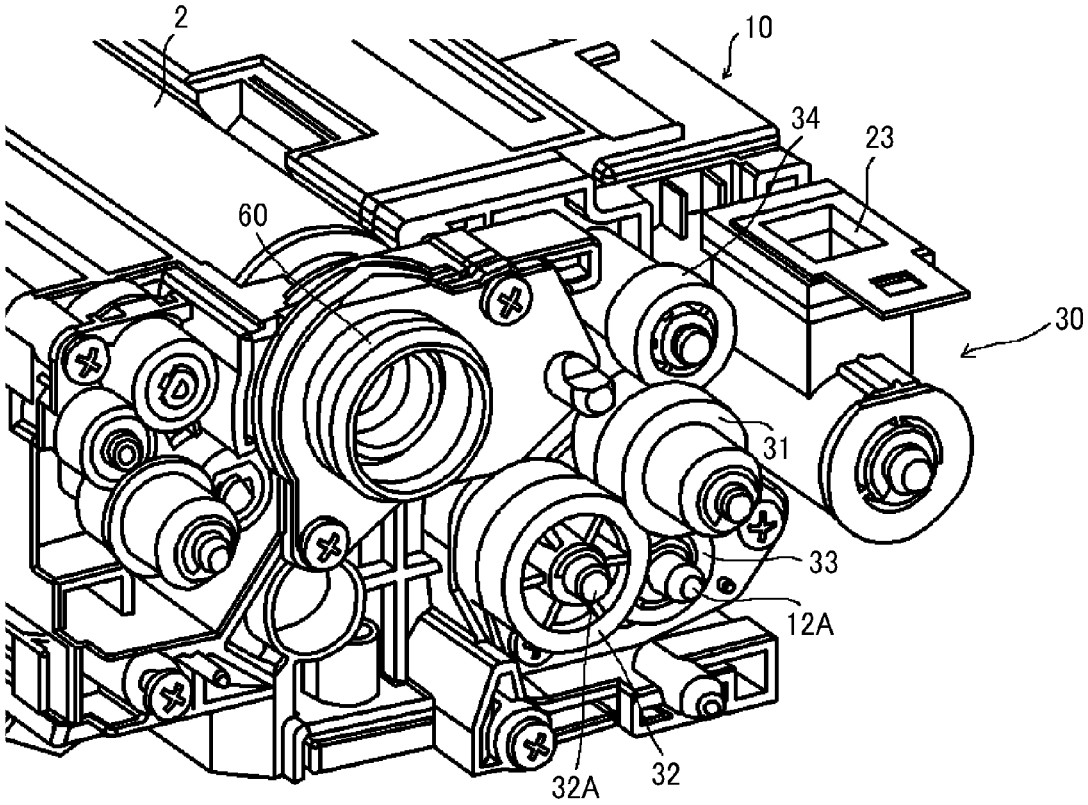
FIG. 7 is an oblique view illustrating a developer driving part from which the developing part duct is removed.
Figure 8:
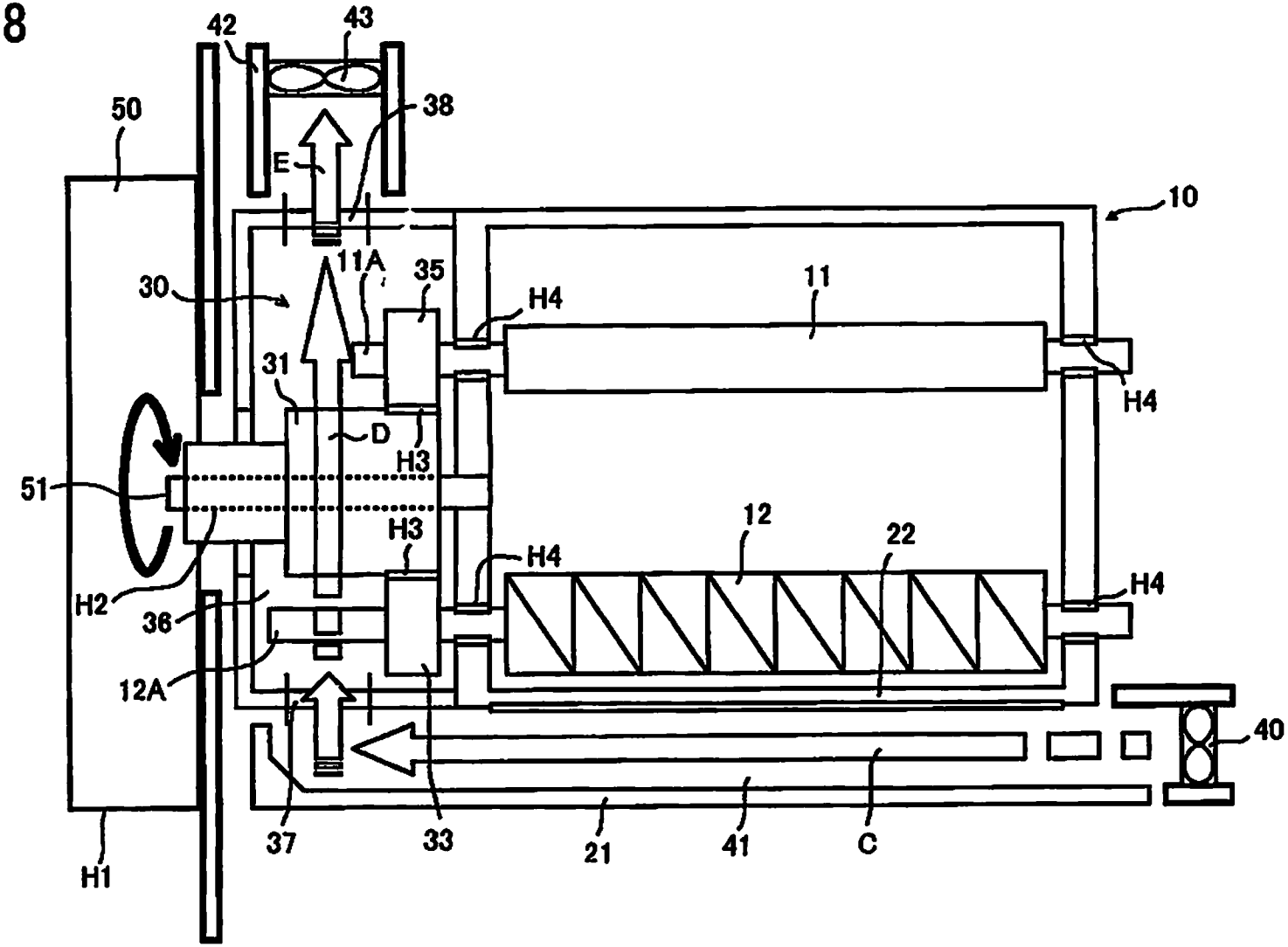
FIG. 8 is a schematic view of a cooling unit as an embodiment of the present invention.
Figure 9:
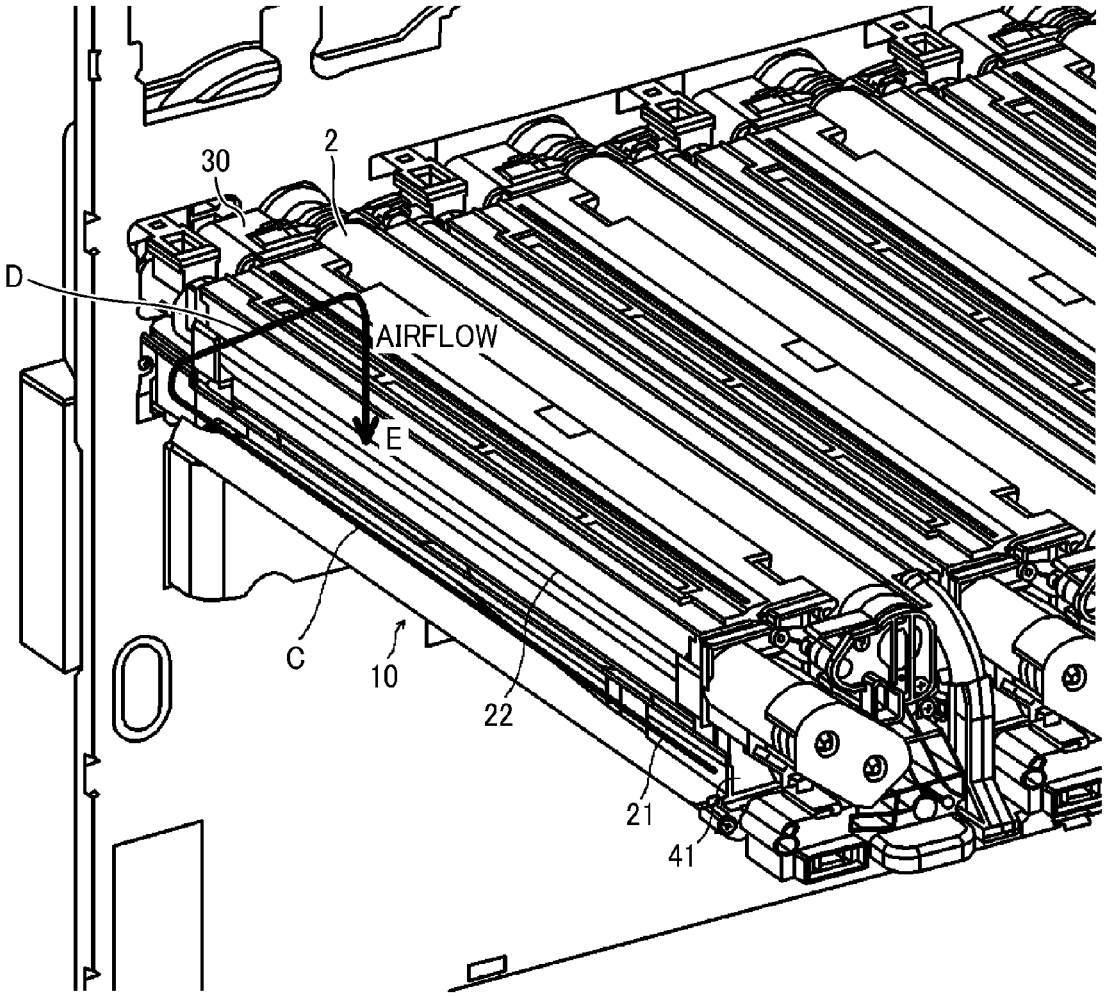
FIG. 9 is an oblique front view of the image forming unit, in which a ventilation direction is shown.
Figure 10:
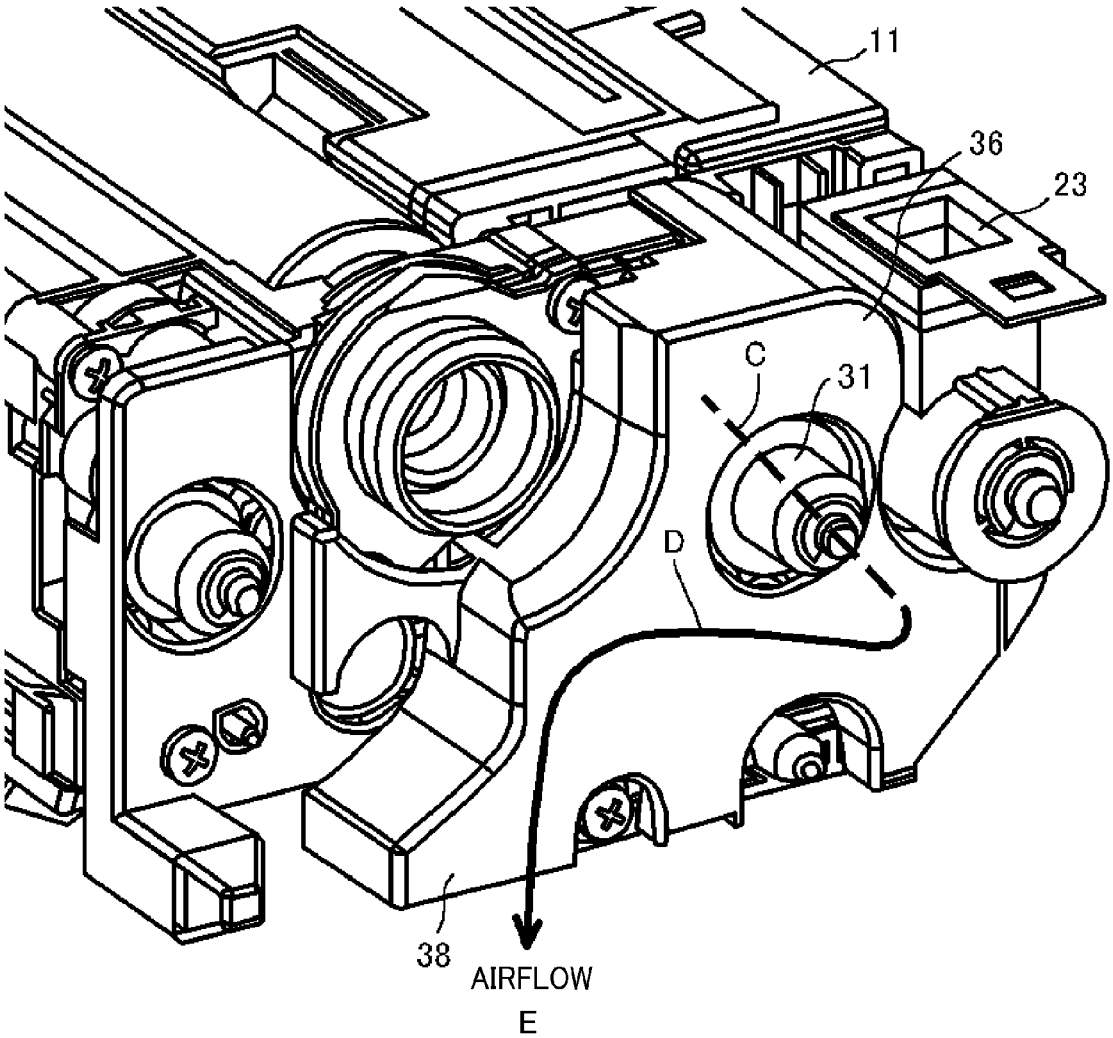
FIG. 10 is an oblique view of the developer driving part in which a ventilation direction is shown.

As illustrated in FIGS. 6, 7 and 8, the developer driving part 30 includes an input gear 31 receiving a driving force from the drive unit 50, a gear 33 fixed to a shaft 12A of the agitation screw 12 and driven and connected via the input gear 31 and an idler gear 32, and a gear 35 fixed to a shaft 11A of the developing roller 11 driven and connected via the input gear 31 and an idler gear 34. The developer driving part 30 is covered by a duct 36 of the driving part, and the gears are covered by the driving part duct 36. (See FIGS. 4 to 7.) Air is blown into the developer driving part 30 covered by the driving part duct 36 to cool the apparatus. The developer driving part 30 further includes an air inlet 37 and an air outlet 38 formed on the driving part duct 36. The driving part duct 36 is formed on the developing device 10 and not on the body of the image forming apparatus 1, and a shaft 32A of the idler gear 32 is engaged with the driving part duct 36 and is held therein.

FIG. 8 shows a schematic view of an embodiment of the present invention, a right side of which is a front side of the body of the image forming apparatus 1 and a left side of which is a backside.

In FIG. 8, a blast fan 40, an airflow generating means, is disposed at the front side of the body of the image forming apparatus 1. The blast fan 40 is connected to the air inlet 37 of the developer driving part 30 via a developer case surface duct 41 disposed along the surface of the developer case 22. The developer case surface duct 41 is a linear duct extending from front to backside of the body of the image forming apparatus 1 along the case surface of the developing device 10. When the blast fan 40 is operated, an airflow C flowing from front to back sides of the image forming apparatus body passes through the duct 41. Alternatively, the developer case surface duct 41 may be implemented as a passage defined by the developer case 22 and the guide rail 21, thereby eliminating the cost of providing a duct.

The air blasted from the air inlet 37 to the driving part duct 36 via the developer case surface duct 41 becomes an airflow D as illustrated in FIGS. 8 to 12, and while cooling the shaft 12A of the agitation screw 12, the shaft 11A of the developing roller 11, and various gears, is discharged from the air outlet 38 to outside the driving part duct 36. The discharged airflow becomes exhaust air E.

Figure 11:
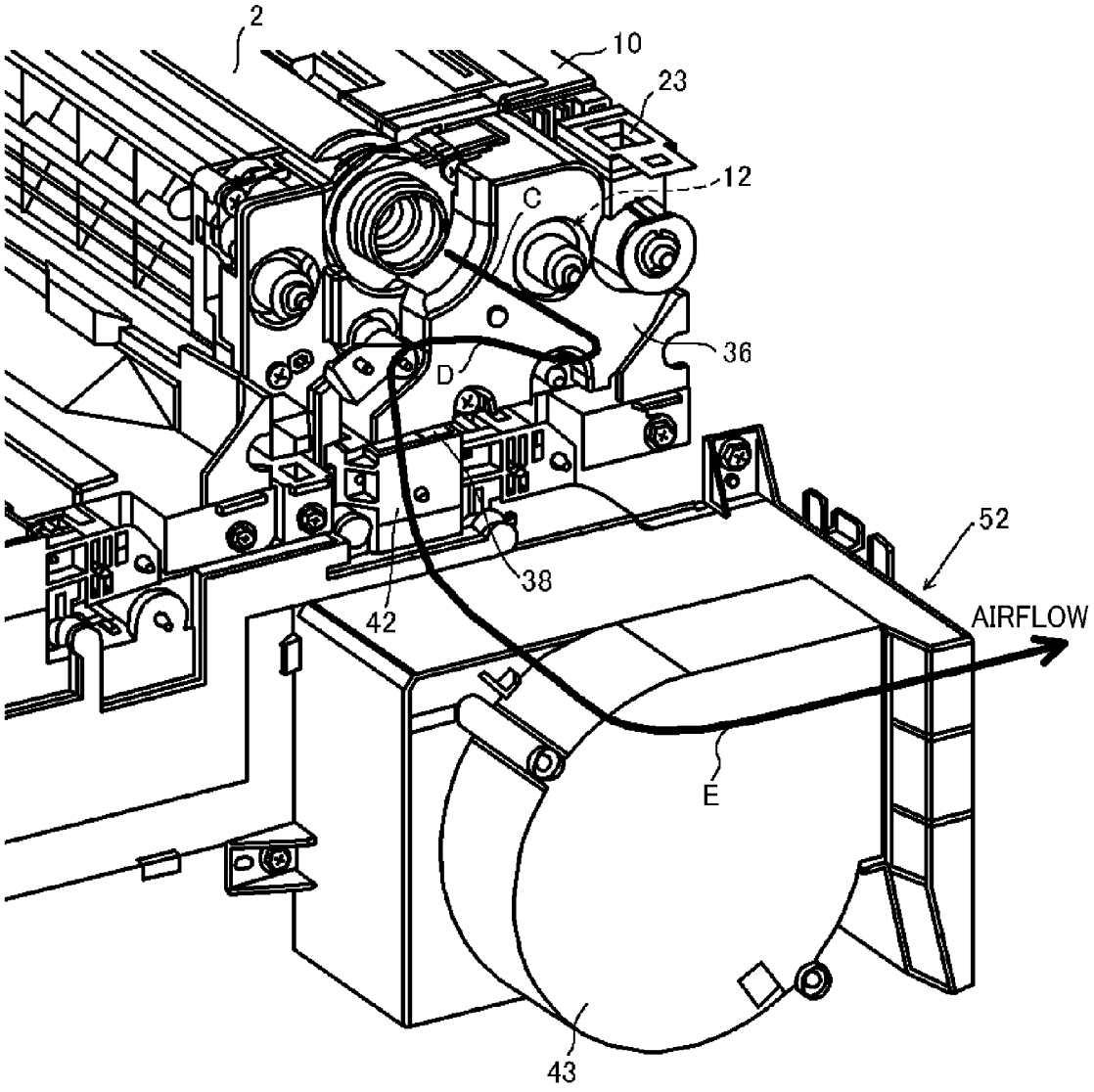
FIG. 11 is an oblique view from the developer driving part to an ejection unit in which a ventilation direction is shown.
Figure 12:
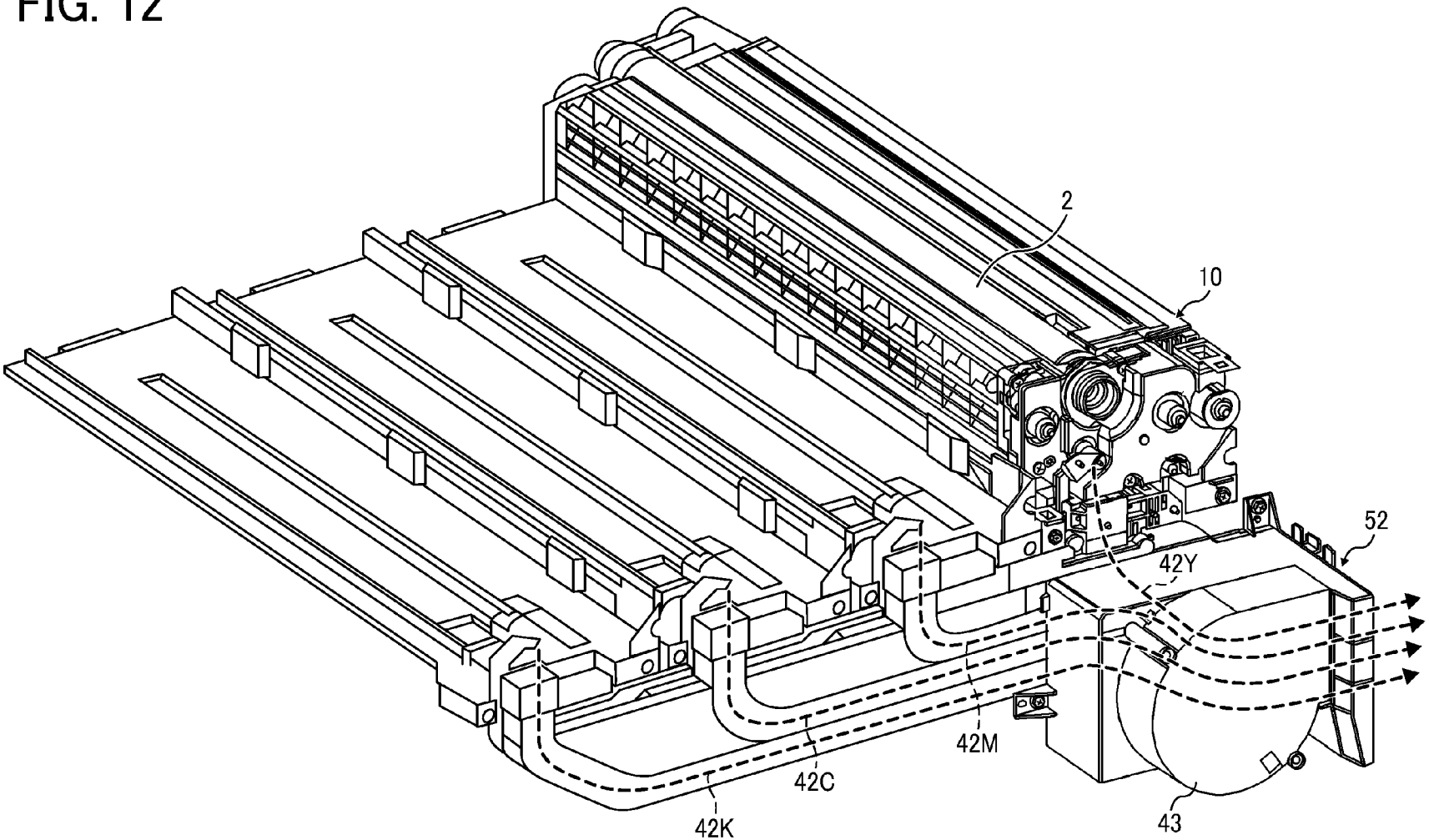
FIG. 12 is an oblique view from each image forming unit to the ejection unit in which a ventilation direction is shown.

The air outlet 38 of the driving part duct 36 is connected to an air exhaust duct 42 disposed on the body of the image forming apparatus 1 as illustrated in FIG. 11 and exhaust air E discharged from the air outlet 38 of the driving part duct 36 flows as shown by an arrow in the figure and is exhausted from an air exhaust part 52 to outside the apparatus. At this time, as illustrated in FIG. 12, the air exhaust part 52 communicates with air exhaust ducts 42Y, 42M, 42C, and 42K of the respective image forming units 20Y, 20M, 20C, and 20K and all exhaust ventilation is performed by a single exhaust fan 43. Specifically, the exhaust fan 43 is configured to exhaust air from the image forming units 20Y, 20M, 20C, and 20K.

The developer inside the developing device 10 is heated by friction between the developing doctor blade and the developing roller and friction of the ingredients of the developer itself. Further, as illustrated in FIG. 8, temperature of the developer increases by H1: heat from the drive unit 50 transmitted to the input gear 31 of the developing device 10, H2: heat caused by a friction between an interior surface of the input gear 31 and a shaft 51 of the drive unit 50, H3: friction heat of the connection surface of gears such as input gear 31, idler gears 32 and 34, and gears 33 and 35, and H4: friction heat of the shaft bearings of such as the developing roller 11 and the agitation screw 12.

The developer inside the developing device 10 is cooled according to the embodiment of the present invention by circulating the air as in the airflow C passing through the developer case surface duct 41 along the surface of the developer case 22 and by absorbing the heat from the surface of the developer case 22. Further, the airflow C is bent flexibly to be introduced into the driving part duct 36 from the air inlet 37 to become the airflow D and strike the drive unit 50, the input gear 31 and a shaft 51 of the drive unit 50, the input gear 31, idler gears 32 and 34, and gears 33 and 35, and the shaft bearings of such parts as the developing roller 11 and the agitation screw 12, thereby directly cooling driving systems generating heat (H1 to H4) causing the temperature of the developer to rise.

The developer inside the developing device 10 is cooled by a series of winds formed by the blast fan 40 and the exhaust fan 43, and the driving system of the developing device 10 as a cause of the temperature rise is cooled. Thus, the heating of the developer can be efficiently reduced using an uncomplicated structure. In the present embodiment, the airflow generating means can be embodied by either the blast fan 40 or the exhaust fan 43 that can generate a flow of air.

The cooling efficiency can be improved by increasing a surface area of the shaft of various gears, the shaft 11A of the developing roller 11, and the shaft 12A of the agitation screw 12 inside the driving part duct 36 to get more airflow.

Figure 13A:
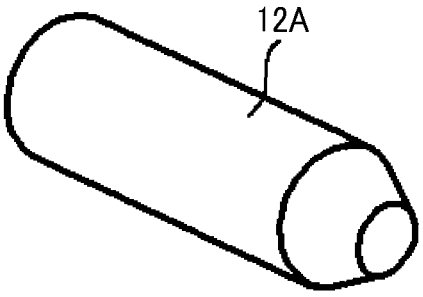
FIGS. 13A to 13D show preferred shapes for a shaft of an agitation screw.
Figure 13B:
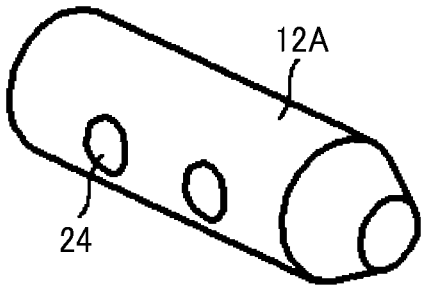
Figure 13C:
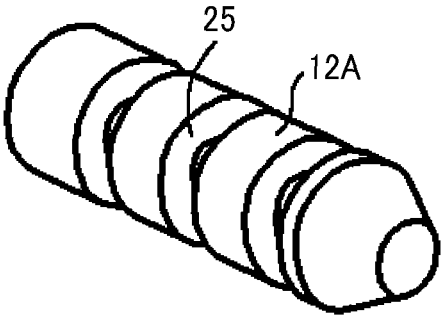
Figure 13D:
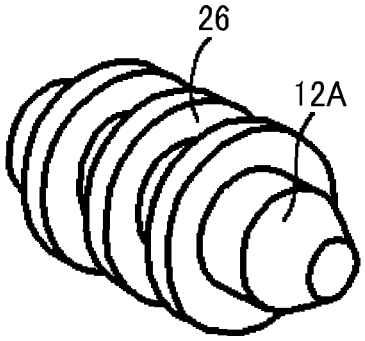

Thus, as illustrated in FIG. 13A, the shaft 12A of the agitation screw 12 is elongated so as to have a larger surface area. As illustrated in FIG. 13B, the shaft 12A of the agitation screw 12 includes a through hole 24 so as to have a larger surface area. As illustrated in FIG. 13C, the shaft 12A of the agitation screw 12 includes grooves 25 along a circumference thereof so as to have a larger surface area. As illustrated in FIG. 13D, the shaft 12A of the agitation screw 12 includes fins 26 so as to have a larger surface area. In the examples as illustrated in FIGS. 13A to 13D, the surface area of the shaft 12A of the agitation screw 12 is increased so that the cooling efficiency can be improved; however, the cooling efficiency can be further improved by increasing the surface area of the shaft of the various gears and the shaft of the developing roller 11.

In the present embodiment, a cooling unit to cool the developing device 10 has been described. However, the cooling target is not limited to a developing device but is also applicable to the fixing device and the transfer device.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a plurality of developing devices each including:

a built-in rotary driving gear including a shaft;

a case, each of the plurality of developing devices being detachably attachable to an image forming apparatus body;

a developer driving part to drive the built-in rotary driving gear disposed at an end in a shaft direction of the built-in rotary driving gear;

a driving part duct enveloping the developer driving part;

a developer case surface duct connecting to the driving part duct and formed along a case surface of the respective developing device parallel to the shaft direction of the rotary driving gear and along a guide surface of a guide member formed by a surface of the image forming apparatus to slidably move the respective developing device when the developing device of the image forming apparatus is attached and detached; and an airflow generating device to blow air from either the driving part duct or the developer case surface duct, wherein the developer case surface duct is disposed to each of the plurality of developing devices.

2. An image forming apparatus as claimed in claim 1, wherein the driving part duct is configured to allow air used upstream to cool the developing case and passing through the developer case surface duct to flow through the driving part duct.

3. An image forming apparatus as claimed in claim 1, wherein the driving part duct is supported by the developing device.

4. An image forming apparatus as claimed in claim 1, wherein the shaft of the rotary driving gear built-in in the developing device is rotatably supported by the driving part duct.

5. An image forming apparatus as claimed in claim 1, wherein the shaft of the rotary driving gear built-in in the developing device is dimensioned to increase a surface area thereof in the developing part duct.

6. An image forming apparatus as claimed in claim 1, wherein the driving part duct is formed of a material having a thermal conductivity higher than that of the case of the developing device.

7. An image forming apparatus as claimed in claim 1, wherein the developer case surface duct is a passage along the length of the developing device.

8. An image forming apparatus as claimed in claim 1, wherein the developer case surface duct is formed by the guide surface of the guide member of the image forming apparatus and a bottom surface of the case of the developing device.

* * * * *